United States Patent [19]

Rohr

[11] Patent Number: 4,467,734

[45] Date of Patent: Aug. 28, 1984

[54] AUTOMATIC APPARATUS FOR CONJOINTLY SUPPORTING AND GUIDING A TUBULAR WORKPIECE

[75] Inventor: Gunter H. Rohr, Hemmingen, Fed. Rep. of Germany

[73] Assignee: Union Special GmbH, Stuttgart, Fed. Rep. of Germany

[21] Appl. No.: 372,366

[22] Filed: Apr. 27, 1982

Related U.S. Application Data

[63] Continuation-in-part of Ser. No. 203,209, Nov. 3, 1980, abandoned.

[30] Foreign Application Priority Data

Apr. 30, 1981 [DE] Fed. Rep. of Germany ..... 3117198

[51] Int. Cl.[3] ..... D05B 23/00; D05B 35/06; D05B 35/10

[52] U.S. Cl. ..... 112/63; 112/121.26; 112/153; 112/305

[58] Field of Search ..... 112/63, 2, 121.26, 121.27, 112/153, 152, 305, 306, 10, 121.15

[56] References Cited

U.S. PATENT DOCUMENTS

| | | | |
|---|---|---|---|
| 1,723,781 | 8/1929 | Hoggard | 112/121.26 |
| 3,448,707 | 6/1969 | Thomsen | 112/121.26 |
| 3,783,805 | 1/1974 | Guichard | 112/121.26 X |
| 3,865,058 | 2/1975 | Rovin et al. | 112/63 |
| 4,046,087 | 9/1977 | Manetti | 112/121.15 |
| 4,098,204 | 7/1978 | Kojima | 112/121.26 |
| 4,147,120 | 4/1979 | Adamski, Jr. et al. | 112/121.26 X |
| 4,185,570 | 1/1980 | Kleinschmidt et al. | 112/121.26 |
| 4,191,117 | 3/1980 | Della Torre | 112/121.26 X |
| 4,265,187 | 5/1981 | Torre | 112/121.26 |

*Primary Examiner*—H. Hampton Hunter
*Attorney, Agent, or Firm*—John W. Harbst; John A. Schaerli

[57] ABSTRACT

A sewing machine apparatus including a work support assembly and a positioning assembly that cooperate in moving a workpiece edge through the sewing station of the machine. The workpiece support assembly is arranged to carry and advance the open end of the workpiece in an endless loop configuration. The positioning assembly operatively rotates with the work support and is effective to influence the lateral placement of the workpiece edge before and during the sewing cycle.

29 Claims, 8 Drawing Figures

AUTOMATIC APPARATUS FOR CONJOINTLY SUPPORTING AND GUIDING A TUBULAR WORKPIECE

This invention is a continuation-in-part of my copending application, Ser. No. 203,209 filed Nov. 3, 1980, and now abandoned.

FIELD OF THE INVENTION

The present invention relates, in general, to sewing machines and, more particularly, to means for supporting and guiding a tubular workpiece edge through the sewing station of a machine.

BACKGROUND OF THE INVENTION

As evidenced in Kosrow et al, U.S. Pat. No. 3,786,768; Adamski, et al U.S. Pat. No. 4,098,201; Rovin, et al U.S. Pat. No. 3,865,058; and Manetti U.S. Pat. No. 4,046,087, automatic hemming apparatus are known. These known systems, although being partially acceptable, require a time consuming process to ensure clamping and alignment of the workpiece edge in its proper position. In addition, the known systems require a complex plurality of moving parts to perform adequately.

SUMMARY OF THE INVENTION

In view of the above, and in accordance with the present invention, there is provided an apparatus which overcomes the above-mentioned drawbacks. Contrary to the known systems, the present invention employs but a simple system of parts for accomplishing its goal. The present invention includes means which are arranged on opposite sides of the stitch forming instrumentalities for supporting the open end of the workpiece edge in a tensioned tubular configuration. The support means are adapted to concomitantly advance the workpiece edge through the machine in synchronous timed relation with the rate of workpiece advancement imparted by the feed mechanism of the machine.

Adapted to cooperate and operatively rotate with, but operate independently of the support means is a unique positioning assembly. The positioning assembly of the present invention is arranged proximate the open end of the workpiece and is adapted to influence the lateral positioning thereof. The positioning assembly of the present invention includes a series of annularly arranged members which rotate, as an assembly, in a first rotational direction but which are also capable of movement in a second rotational direction that is orthogonal to the first.

The support means and the positioning assembly are each provided with a driver for rotating same. The present invention is also provided with means for monitoring the lateral position of the workpiece edge. The monitor or sensor means is connected to the drives such as to control the relative rotational speeds of the support means and the positioning assembly. A coupling or adjusting member is interposed between the drive for the positioning means and the independent rotatable members. When the relative rotational speeds of the support means and positionign assembly vary, as controlled by the monitoring means, the adjusting member is effective to impart rotational movement to the alignment members such that they act relatively independent of the support means. As understood, the movement of the rotatable members influences the lateral position of the workpiece edge. When the workpiece edge is in its predetermined position, the need for any lateral correctional movement is reduced and the support means for positioning means synchronously turn, that is, there is no relative motion therebetween.

In the preferred embodiment, the support means are horizontally shiftable toward the positioning means to create a material surplus or fold proximate the positioning assembly. The creation of this material surplus allows for positioning of the workpiece edge without having to shift the entire length of the workpiece.

In line with the above, it is a primary feature of this invention to provide an apparatus for automatically advancing a tubular workpiece wherein feeding and positioning of the workpiece edge is controlled to ensure proper workpiece formation.

Another feature of this invention is the provision of a unique positioning apparatus which aligns the workpiece edge prior to and during the sewing operation.

Another feature of object of this invention is the provision of suitable means which can support, guide, and concomitantly feed the edge of a tubular workpiece through a sewing machine with relatively simple means.

Another feature of this invention is to provide an apparatus of the above described type which will embody relatively few parts, each individually simple and rugged in construction and these parts operating over long periods of time with freedom from difficulties.

Still another feature of this invention is the enclosure of the means for operating the mechanism within the mechanism itself.

Still another feature of this invention is the formation of a combined support and positioning assembly wherein minimal driving energy is expended during operation of the assembly.

BRIEF DESCRIPTION OF THE DRAWINGS

Having in mind the above objects and other attendant advantages that would be evident from an understanding of this disclosure, the invention comprises the devices, combinations, and arrangements of parts as illustrated in the presently preferred embodiments of the invention which are hereinafter set forth in detail so as to enable those skilled in the art to readily understand the function, operation, construction and advantages of same when read in conjunction with the accompanying drawings in which.

DETAILED DESCRIPTION OF THE PRESENT INVENTION

Figure 1:
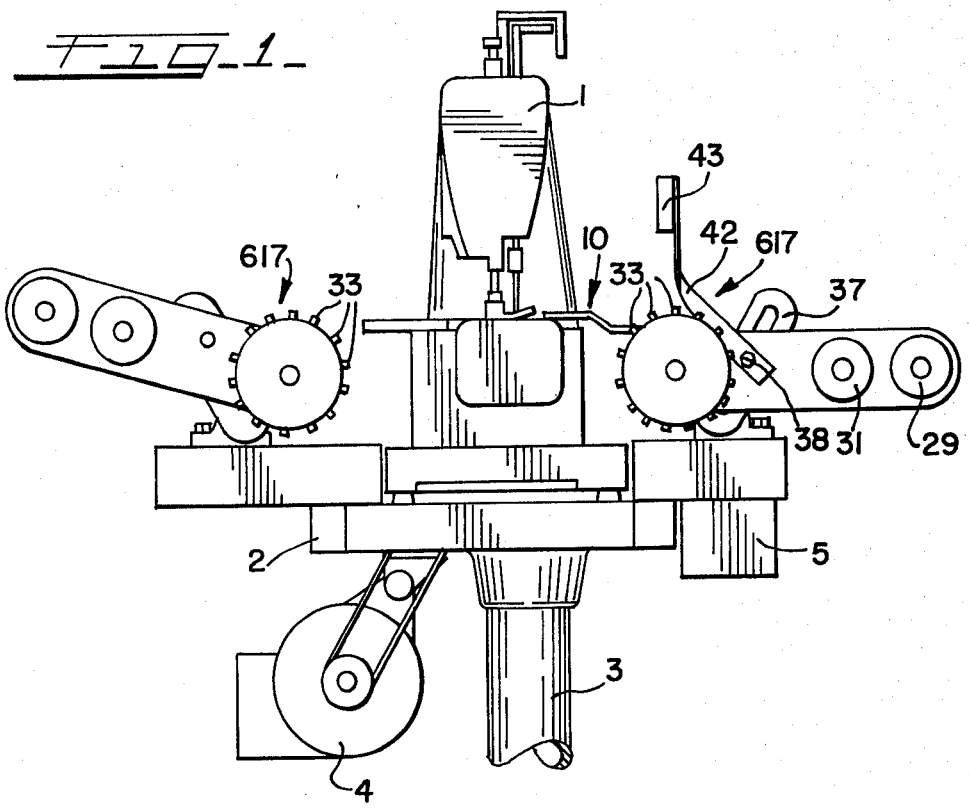
FIG. 1 is an end view of one embodiment of the present invention.
Figure 2:
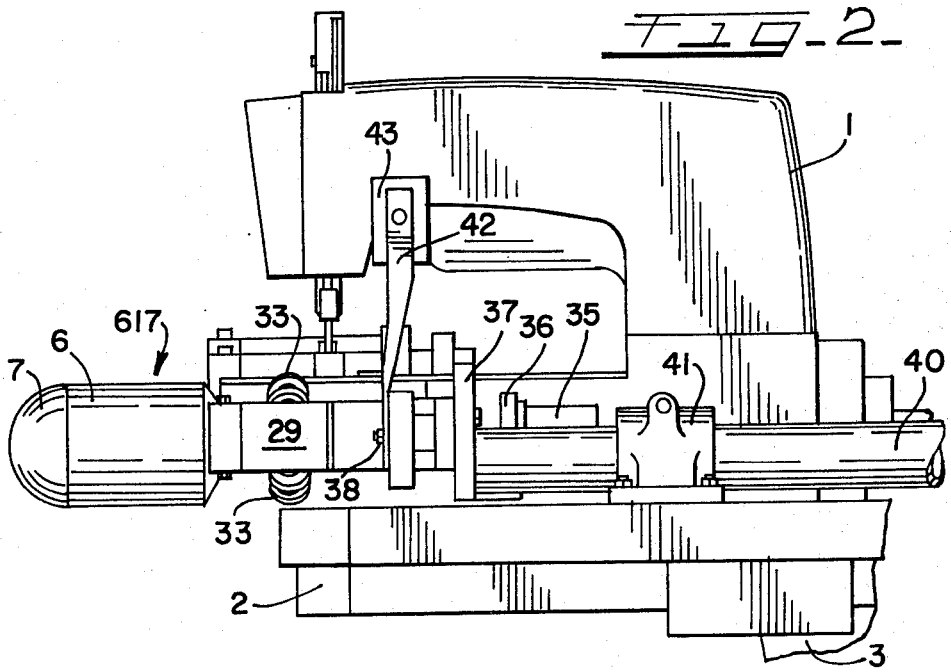
FIG. 2 is a front elevational view of the present invention.
Figure 5:
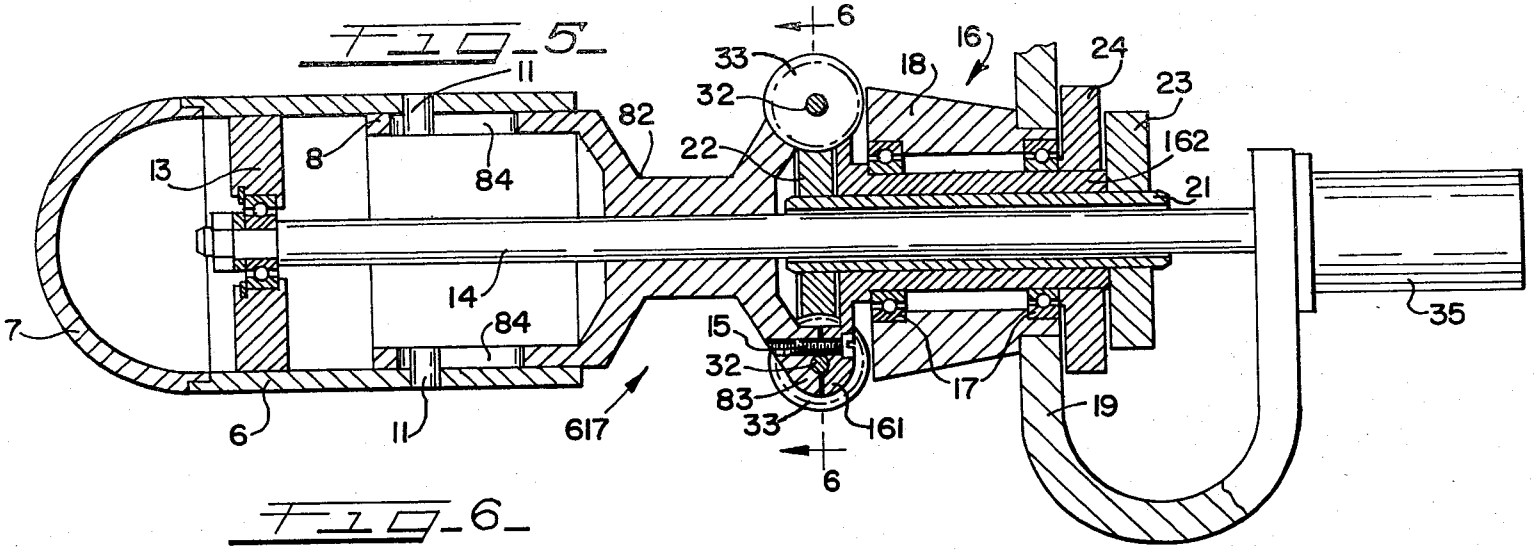
FIG. 5 is a sectional view of the present invention taken approximately through the midsection of the apparatus.

Referring now to the drawings, wherein like reference numerals indicate like parts throughout the several views, there is shown in FIG. 1 a sewing machine 1 to which the present invention may be applied. Suffice it to say that the machine 1 includes the usual reciprocatory needle means that are driven toward and away from the stitch forming location, a work support means and the usual four motion feed mechanism for advancing the workpiece edge through the stitch forming location. For purposes of this description, it may be said that the feed mechanism for the machine 1 is similar to that shown in U.S. Pat. No. 3,472,188 issued Oct. 14, 1969 to R. A. Hayes. The machine is supported on a work table 2 that is provided with a depending pedestal type stand 3. The work table 2 also supports a well known sewing machine drive motor 4 and a switch and control box 5. Arranged forward of the stitch forming point is a folding element means 10 adapted to form a hem fold in the edge of the material as it passes into the sewing station. Arranged on opposite sides of the stitch forming location is an apparatus, generally identified 617. The apparatus 617 is provided for supporting the workpiece edge in a tubular or endless loop configuration and for influencing the movement of the workpiece past the stitch forming instrumentalities of the machine. The apparatus of the present invention may be considered as including a support assembly and a guiding or positioning assembly. The support assembly includes a roller or cylindrical housing 6 extending in a generally horizontal position and whose rotational axis extends generally perpendicular to the direction of workpiece advancement. As will be subsequently described, the rollers 6 are adjustable relative to one another so that the endless loop or annular formation of the workpiece edge is subject of a light tension. The cylindrical housing 6 is closed at one end by an end cap 7, preferably of hemispherical shape. As best seen in FIG. 5, the roller 6 is telescopically received over the free end of a tubular extension 8 and is longitudinally slideable thereon. Circumferentially arranged about the support 6 are a series of inwardly projecting pins 11. The pins are adapted for reception in longitudinal slots 84 arranged about the free end of the extension 8. By this construction, relative rotational movement between the support 6 and extension 8 is prevented, but free sliding movement of the support 6, over the extension 8, to the extent allowed by the longitudinal length of slot 84 is allowed. The extension 8 has a reduced diameter midsection, generally designated 82, which in the embodiments shown, is a V shaped constriction. The other end of the extension 8 is formed as a radially slotted flange 83. Abutting the flange 83 is the distal end of the drive unit, generally designated 16.

The drive unit 16 for the present invention includes a tubular extension or housing 18 that is fixedly supported on the projecting arm of a bracket 19. The housing 18 has a truncated peripheral surface that is angled downwardly and away from a subsequently described guide means 33. A power shaft 162 is journaled for rotation within the housing 18 by means of bearings 17. As seen in FIG. 5, the left end of shaft 162 is formed with a radially slotted flange 161 that is connected to the extension flange 83 through means of screws 15 or the like. The other end of shaft 162 is provided with a drive pulley 24 about which is entrained suitable transmission means 25. The transmission means extend to a pulley 28 and drive motor 31 that serve to impart rotational movement to the support means so as to impart a concomitant advancing motion to the open end or edge of the workpiece.

The positioning element of the present invention includes a series of annularly mounted rotatable members 33. The positioning assembly engages the workpiece adjacent one end thereof and is adapted to influence the positioning of the workpiece edge in a direction transverse or lateral to the feeding direction without affecting the feed in the sewing direction. In one embodiment, the positioning means, including wheels 33, is integrally arranged with the work support means about a common axis. It will be understood that the minimum circle which totally encompasses the wheels 33 is greater than the maximum diameter of the rollers. That is, a portion of the periphery of the wheels extend beyond the periphery of the rollers such that the aggregate diameter of the positioning assembly is greater than the outside diameter of the rollers 6. It will be understood, however, that the positioning assembly may be mounted independent of, while remaining cooperative with, the work support means, without departing from the principle and scope of the operation of the present invention. In the illustrated embodiment, the abutting faces of the slotted flanges 83 and 161 are adapted to receive and hold fast a series of pins or stub shafts 32 about which the wheels 33 rotate in a direction transverse to the rotational direction of the rollers 6. The longitudinal axis of each stub shaft 32 is tangential to a circle arranged concentric with the outside diameter shaft 162. The rotatable members 33 are drivingly associated with a rotary actuator or coupling 22 which may be in the form of a worm gear. The motion imparting member 22 is fixedly mounted adjacent one end of a tubular or hollow shaft 21 which is telescopically supported for rotation within the power shaft 162. The other end of shaft 21 is provided with a drive pulley 23 about which a motion transfer means 26 is entrained. The transmission means 26 extends to pulley 27 and drive motor 29, the latter being fixedly mounted on the extended arm of bracket 19. Ultimately, the motor 29 serves to impart motion to the wheels 33 in a timely manner subsequently described.

As mentioned above, the support means 6 of the present invention are slideably movable relative to the extension 81. To provide longitudinal sliding movement to the rollers 6, a driver 35 having a retractable/extendable rod 14 is provided. The driver may be secured to the bracket 19. In its assembled form, the extendable rod 14 projects through the tubular member 21 and is provided at its free end, with a radially extending member 13. The member 13 serves to connect the cylinder 6 with the operative end of driver 35.

Figure 3:
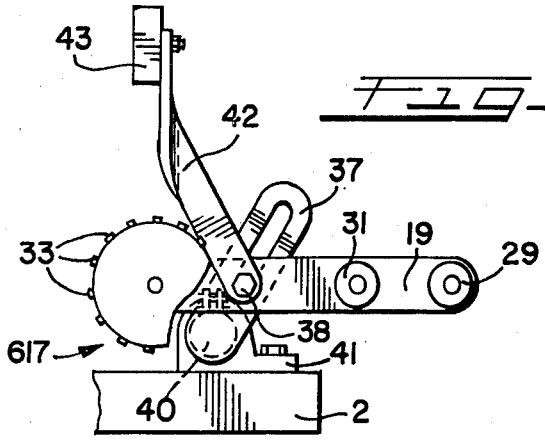
FIG. 3 is a detailed end view showing part of the present invention.
Figure 4:
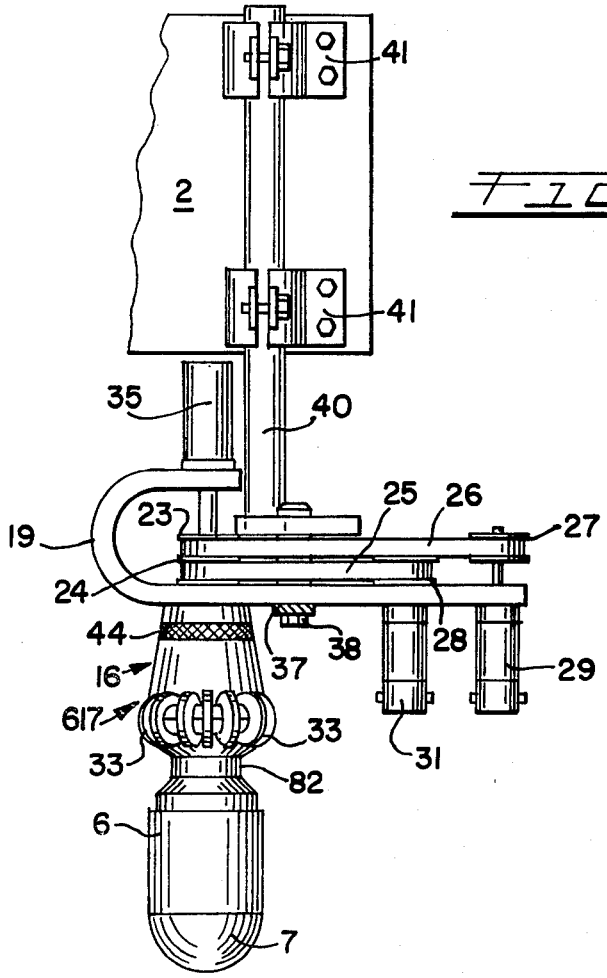
FIG. 4 is a partial plan view of one embodiment of the present invention.

As best seen in FIGS. 3 and 4, the bracket or holder 19 is fastened to a pivotally movable slotted arm 37 by means of a bolt 38. The arm 37 is connected to an extendable/retractable carrier 40 which, in turn, may be clamped in any select position by clamps 41 arranged on the work table 2. By this construction, the assemblies 617 may be shifted, turned, and fastened in different positions to change the centerline distance therebetween whereby compensating for variances in workpiece sizes.

In the illustrated embodiment, suitable sensor means 43 are positioned in advance of the sewing area by means of a carrier 42. The sensor means serve to monitor the lateral position of the workpiece edge relative to the switch forming location. An appropriate reflector 44, arranged on the housing 18, may be disposed opposite to the sensor means 43 if the conditions warrant the use of same.

Figure 7:
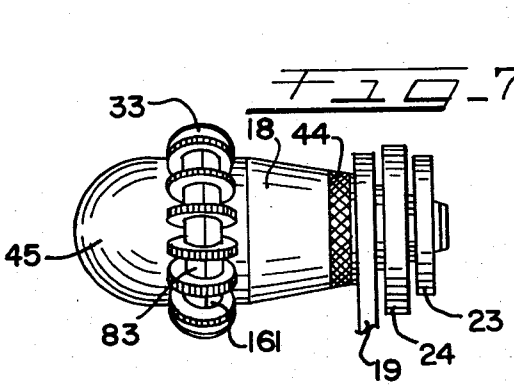
FIG. 7 is an elevational view of a second form of the present invention.
Figure 6:
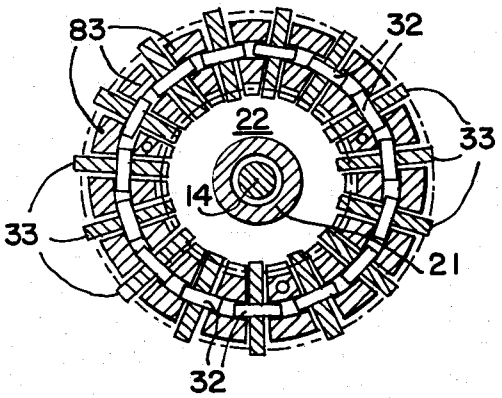
FIG. 6 is a sectional view taken along Line 6—6 of FIG. 5.

A second embodiment of the invention is shown in FIG. 7. The constructive features of this second embodiment are similar to that described above with the exception that the support means 45 do not outwardly project as far as does the housing or support 6. It follows that this latter embodiment may be employed for use on shorter workpieces, for example, in the production of a cuff on sport trousers or the like.

In operation of the device, a tubularly shaped workpiece is positioned about the periphery of the supports 6, just past the positioning device 33 such that the open end of the workpiece lies generally adjacent the reflector 44. After positioning the workpiece such, but before the sewing cycle commences, the support 6 is drawn, by way of the driver 35, toward the positioning device 33 to create a surplus of material or material fold near the workpiece edge. The surplus material may be stored in the open area 82 which acts as a material buffer or storage zone. As is understood, the material stored in this buffer zone facilitates the aligning of the workpiece edge by making possible a shifting of the workpiece edge without having to shift the entire workpiece in a direction transverse to the sewing direction.

Prior to actuation of the machine 1, but having once stored the adequate amount of material in the buffer zone 82, the drivers 29 and 31 are actuated. Actuation of the drivers cause the housing 6 and positioning device 33 to rotate. Of course, this action rotates the material around its major axis, thus causing the workpiece edge to move past the sewing station. At this time, the rollers and positioning device rotate together in a first rotational direction. Thereafter, the positioning device 33, under the control of the sensor means 43, is effective to influence the lateral position of the workpiece edge so as to urge same into the desired position and into the guide device 10. Understandably, the lateral shifting of the workpiece edge is accomplished by the actuation of the wheels 33. It will be appreciated by one skilled in the art that the individual wheels are adapted to turn in a second rotational direction which is orthogonal to the first rotational direction. The relative movement imparted to the wheels is accomplished by modulating the relative speeds of the drivers 29 and 31. That is, when the rollers 6 and positioning assembly turn at different speeds, movement is imparted to the wheels 33 relative to the rollers 6. In contrast, when the material edge is properly located relative to its predetermined position, the drivers turn synchronously, and thus no movement is given to the wheels.

Assuming now that all of the above listed operations have taken place and the material edge has run into the hem folder 10, the sewing cycle commences. During sewing, the support means advances the material in synchronization with the advance movement imparted to the workpiece by the feed mechanism. While the workpiece edge is running past the sewing station during the sewing process, the sensor means 43 remains active. Thus, if for whatever reason, the workpiece edge is displaced from its predetermined position, the positioning device is effective to influence the lateral shifting of the edge whereby returning same to its predetermined position. Once the entire circumferential length of the workpiece edge has passed through the sewing area, that is, once the edge of the tubular article has passed through the cycle defined by substantially 360° of workpiece rotation, the machine is stopped by any suitable means such as a stitch counter or sensor means. After the machine stops, the sewing threads are cut and the sewing machine presser foot is raised so that the completed workpiece may be removed.

Figure 8:
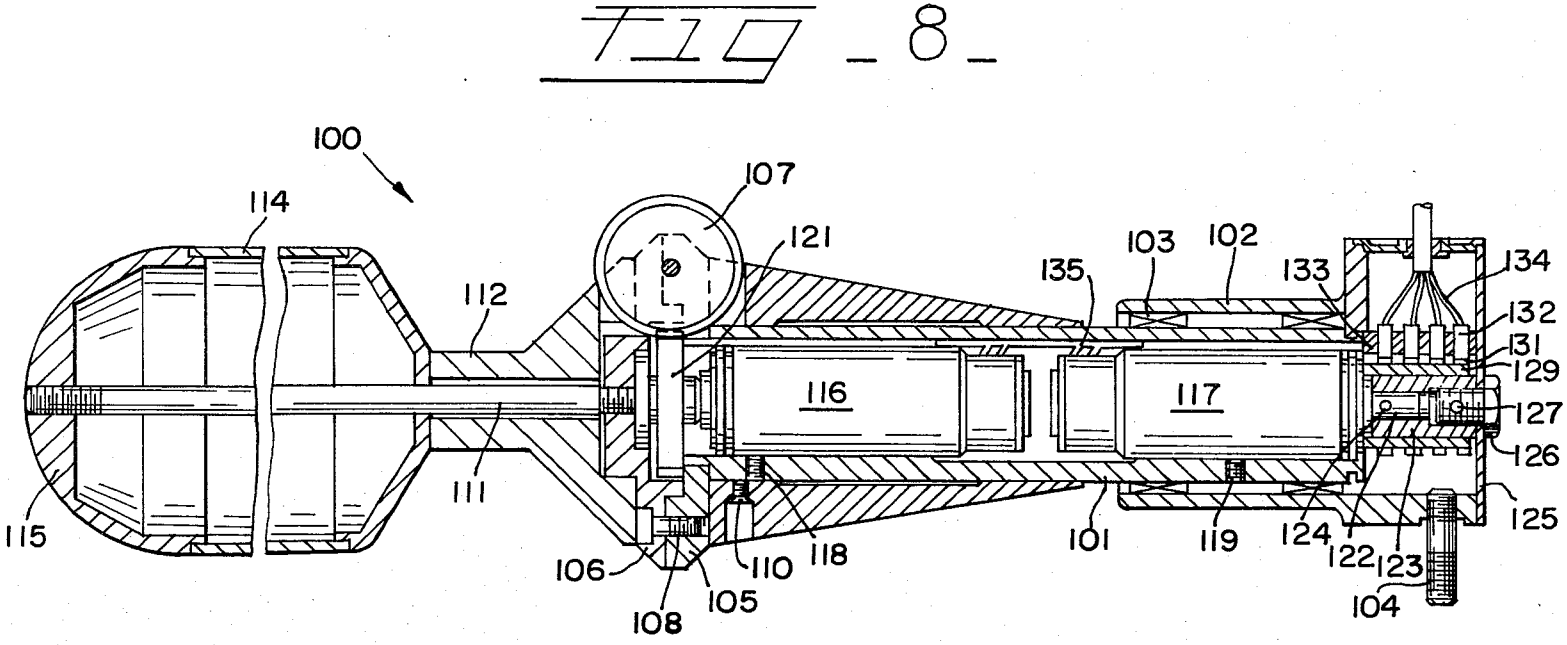
FIG. 8 is a longitudinal sectional view similar to FIG. 5 taken through another form of mechanism.

Some may view the embodiment shown and described above as having objectionable characteristics in that the above design is spacious and exposes the operating parts, i.e. activating motors and transmission means, to a dusty, lint laden environment in which this invention finds utility. Accordingly, there has been developed a modification of the apparatus 617, the modification being shown in FIG. 8 with a compact support and positioning assembly being identified generally by reference numeral 100. As with assembly 617, the modified embodiment includes a rotatable tensioning part and workpiece alignment means. More particularly, the compact assembly 100 includes a tubular sleeve or housing 102 provided with suitable fastening means 104 for effecting a convenient mounting of the entire support and positioning assemblage relative to a sewing machine or other machine as shown in FIG. 1.

In this embodiment, the workpiece alignment or positioning means is located at the free end of a tubular power shaft 101. Forming part of the positioning assembly is a slotted flange 105 which is mounted on and is adapted for rotation with the tubular power shaft 101; the power shaft 101 being journaled for rotation within the housing 102 by means of bearings 103. A second slotted flange 106 is fixedly secured to flange 105 by means of fasteners 108. A series of rotative members or wheels 107 are arranged in an annular manner between the abutting faces of the slotted flanges 105 and 106 on a series of pins or stub shafts. The wheels 107 are located in slots which extend in planes radially of the axis of rotation of the assemblage 100. By means of fastener 110, a cylindrical element having a truncated peripheral surface may also be fixedly arranged on the power shaft 101 intermediate the positioning means and the support housing 102.

Extending forward of or away from the aligning or positioning means is the rotatable tensioning and support assembly of this embodiment. As with the other embodiments, the tensioning part is adapted to receive at least part of the tubular workpiece to be sewn and serves to feed the workpiece edge that is to be sewn toward the stitching location of the sewing machine. The supporting assembly is adapted for rotation about a shaft or a rod 111 having one end secured to the flange 106 and which coaxially extends away from the power shaft in a direction generally perpendicular to that of workpiece advancement. In the form shown, the support assembly includes a generally V shaped extension 112, a cylindrical housing or roller 114 and an end cap 115, preferably of hemispherical shape. The extension 112 is fixedly carried for rotation with the flange 106. The end cap 115 is threadably received on the distal end of the rod in such manner to maintain the parts of the supporting assembly in an aligned relationship. As with the other embodiments, it is to be understood that the minimum circle which totally encompasses the wheels 107 of the positioning assembly is greater than the maximum diameter of the support assembly. That is, a portion of the periphery of wheels 107 extend beyond the periphery of the support assembly such that the aggregate diameter of the positioning assembly is greater than the outside diameter of the supporting assembly.

In this third embodiment, the means for driving the combined support and positioning assembly are uniquely arranged in a substantially dust free environment and in a manner whereby compactness of the unit is achieved. The driving means include motors 116 and 117 which are coaxially arranged within the tubular power shaft 101 and are fixedly secured thereto by any suitable fasteners such as 118, 119, respectively. In the form shown, motor 116 is adapted to independently operate the positioning assembly while the motor 117 drives the entire assemblage including the tensioning parts and alignment means. Arranged at the operative end of motor 116 is a worm gear 121 which defines a rotary actuator or coupling for drivingly associating the motor 116 with the wheels 107. The output shaft of the motor 117 is pin connected, as at 124, with a coupling element 123. The coupling element 123, in turn, is secured, by means of a bolt 126 and pin 127 connection, to a stationary cover 125 arranged on the end cap of the housing 102. In this manner, the output shaft 122 of the motor 117 is nonrotatably secured to the housing 102. Also, by this construction, dust and other foreign matter is maintained out of the assemblage thereby allowing the motors to operate in a substantially dust free environment.

To enable energization of the motors 116 and 117, a cooperating slip-ring and brush assembly is provided. In the illustrated embodiment, the slip-ring assembly includes a cylindrical extension 129 of the housing of motor 117. About its periphery, the cylindrical extension is provided with a series of slip-rings 131. An insert 133 carried within the end cap of the housing 102 is provided with a series of brush contacts 132 which cooperate to transmit energy in the usual manner. Suitable leads 134 are connected to the brush contacts 132 of the slip-ring assembly. Motor leads extending through a suitable cable channel 135 are also connected to the same contacts for energizing the motors 116, 117.

In this embodiment of the invention, energization or actuation of the motor 117 will result in both the positioning assembly and support assembly being rotatably driven as a single assemblage or unit thus conserving the usage of energy. This result is achieved by fixedly securing the output shaft 122 of the motor 117 to the stationary housing, while affixing the power shaft 101 to the casing of the motors. The rotation of the power shaft also affects rotation of the motor 116 through the connection 118. By turning the motor 116 in timed relation with the turning of the input drive, no turning movement of the gears or wheels 117 about their axis result as long as the motor 116 remains unenergized. That is, the rollers 107 and support assemblage rotate together in a first rotational direction. The motor 116 may be controlled in the same manner as was the positioning motor in the above two described embodiments. That is, by sensing the lateral position of the workpiece edge relative to a predetermined point the motor 116 may be fed corrective data from the monitoring means which, in turn, controls the adjusting member 121 to transfer relative movement to the wheels in a second rotational direction according to the deviation of the workpiece edge from its predetermined position. In this manner, although the workpiece edge may continually be fed through the work station a lateral movement of the workpiece may also be achieved.

It will be understood, that in most circumstances, only the work support in front of the machine need be provided with a positioning assembly as described above. In some cases, however, where the workpiece edge may be wavy and, thus, difficult to properly align, it is advantageous to equip both work support members with a positioning assembly.

Thus, it is apparent that there has been provided, in accordance with the invention, an Automatic Apparatus For Conjointly Supporting and Guiding A Tubular Workpiece that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus adequately described my invention, what I claim is:

1. In combination with a sewing machine having stitch forming instrumentalities for working on an advancing tubular workpiece edge and means for forming a fold in the tubular workpiece edge at a position in front of the stitch forming instrumentalities, an apparatus for moving the workpiece edge past the stitch forming instrumentalities comprising:

at least two mechanically driven rotatable support means adapted to receive and concomitantly advance the open end of said tubular workpiece;

mechanically driven positioning means including a series of annularly arranged wheels located adjacent the open end of said tubular workpiece and adapted for rotation with said support means for controlling the lateral disposition of the workpiece edge; and sensor means for detecting lateral deviation of the workpiece edge beyond a predetermined range and for controlling the influence of said positioning means on said workpiece edge.

2. An automatic apparatus arranged in combination with a machine having a work support means and a tool adapted to perform an operation along the edge of a tubular workpiece through a cycle defined by substantially 360° of workpiece rotation, said automatic apparatus comprising:

tubular work support and feeding means adapted for rotation about an axis extending generally parallel to the work support means of the machine;

positioning means including a series of annularly arranged rotatable members adapted for cooperative rotation with the rotation of said work support and feeding means for influencing the lateral position of the workpiece edge relative to said tool; and sensor means adapted to monitor the lateral position of said workpiece edge relative to said tool and for controlling the positioning means so that the workpiece edge is maintained in a predetermined position relative to said tool.

3. In combination with a sewing machine adapted to operate along the edge of a tubular workpiece, an apparatus comprising:

workpiece tensioning means including at least two roller means for engaging and supporting the open end of a tubular workpiece, at least one of said roller means being mechanically driven;

rotatably driven positioning means adapted to cooperate with said tensioning means and arranged to engage the tubular workpiece adjacent the open end thereof, said positioning means being driven independently of said tension means and includes a series of driven wheels arranged in an annular fashion for influencing the lateral position of the workpiece edge when the relative rotational speeds of said tensioning means and positioning means differ; and sensor means for controlling the relative rotational speeds of said tensioning and positioning means according to the lateral placement of said workpiece edge.

4. In combination with a sewing machine having means for performing a stitching operation along the edge of a tubular workpiece, folder means for creating an unsewn hem in the edge of the workpiece, an apparatus comprising:

at least two mechanically driven support means for carrying said workpiece in a tubular configuration;

means for positioning the open end of said tubularly configured workpiece relative to said folder means, said positioning means includes a series of annularly disposed wheels adapted to engage the open end of said tubularly configured workpiece and drive means for imparting movement to said wheels to influence movement of the workpiece edge in a direction transverse to the rotational direction of said supporting means, and means for monitoring and controlling the lateral placement of the workpiece edge by influencing the motion imparted to said wheels whereby effecting the lateral movement of the workpiece edge.

5. The invention according to claims 1 or 4 wherein said support means are mounted for adjustment relative to each other to accomodate tubular workpieces of various sizes.

6. In combination with a sewing machine having a work support means, stitch forming instrumentalities for working along the edge of a tubular workpiece and means for advancing the workpiece past said sewing instrumentalities, an apparatus comprising:

at least two cylinder means for supporting the tubular workpiece in a loop;

means for mounting the cylinders rotatably on either side of the stitch forming instrumentalities in a generally horizontal position with its rotational axis extending generally perpendicular to the direction of workpiece advancment;

means for rotating at least one of said cylinders in synchonization with the advancement of the workpiece;

means for monitoring the placement of the workpiece edge relative a predetermined position;

means responsive to said monitoring means for influencing the placement of the workpiece edge relative said predetermined position, said means responsive includes a series of annularly arranged rotatable members located adjacent the open end of said tubular workpiece, means capable of rotating said means responsive in a first rotational direction with said cylinder means and for rotating said rotatable members in a second rotational direction to impart a lateral movement to said workpiece edge as required.

7. The invention according to claim 6 wherein said first and second rotational directions are orthogonal relative to each other.

8. The invention according to claim 6 wherein the free end of said cylinder means is provided with hemispherically shaped end closures.

9. In combination with a sewing machine adapted to operate along the edge of a tubular workpiece as it advances through the machine, a mechanism comprising:

at least two cylinder means arranged for rotation about an axis extending generally perpendicular to the workpiece advance movement, said cylinder means serving to support and advance the open end of said tubular workpiece in a loop;

a substantially circular rotatable workpiece guide means coaxially arranged with said cylinder means for influencing the lateral position of the workpiece edge and over which the open end of said tubular workpiece is positioned, said guide means having a concentrically larger aggregate diameter than the diameter of said cylinder means;

said guide means including an assembly of annularly arranged rotatable means and a drive operatively associated with an effective to rotate said rotatable means in a direction transverse to the rotational direction of said guide means when the relative rotational speeds of said workpiece guide means and cylinder means differ; and means for controlling the relative speeds of said guide means and said cylinder means as a function of the lateral position of the workpiece edge.

10. In a sewing machine having stitch forming instrumentalities for working along the advancing edge of a tubular workpiece, the combination of an apparatus comprising:

a fixed housing including means for rotatably mounting at least two cylinder means on opposite sides of said stitch forming instrumentalities such that the open end of said tubular workpiece is supported in a loop configuration;

at least one aligning assembly coaxially arranged with respect to one of said cylinder means at a location proximate the open end of said tubular workpiece;

a driver for rotating said aligning assembly;

said aligning assembly including a series of annularly arranged wheels whose aggregate diameter is greater than the diameter of said cylinder means, said wheels being effective to urge the workpiece edge in a direction transverse to the rotational direction of said cylinder means, coupling means interposed between said driver and said wheels for rotating said wheels when the relative rotational speeds of said cylinder and guide means vary; and means for regulating the relative rotational speeds of said cylinder means and guide means in response to the lateral position of the workpiece edge.

11. In a sewing machine having stitch forming instrumentalities for operating along the advancing edge of a tubular workpiece, the combination of an apparatus comprising:

a fixed housing including means for rotatably mounting at least two cylinder means on opposite sides of said stitch forming instrumentalities such that the open end of said workpiece is supported in a tubular configuration;

at least one rotatably mounted aligning assembly arranged proximate the open end of said tubular workpiece;

a driver for rotating said aligning assembly;

said aligning assembly including a plurality of annularly arranged wheels effective to urge the workpiece edge in a direction transverse to the rotational direction of said aligning assembly, coupling means interposed between said driver and said wheels for rotating said wheels when the relative rotational speeds of said cylinder means and said aligning assembly vary; and means for regulating the relative rotational speeds of said cylinder means and guide means in response to the lateral position of the workpiece edge.

12. The invention according to claim 10 or 11 wherein said housing has a truncated peripheral surface that is angled downward and away from said guide means.

13. The invention according to claim 10 or 11 wherein said coupling means is a rotatably driven worm gear having said wheels operatively associated therewith.

14. The invention according to claim 10 or 11 wherein said cylinder means is slideably movable toward said aligning means so that material will be gathered at a position adjacent the aligning assembly.

15. With a sewing machine having means for securing a fold in the advancing edge of a tubular workpiece and a worksupport means, the combination of an apparatus comprising:

a fixed housing having means for rotatably mounting at least two rollers such that the open end of said tubular workpiece is supported in an annular loop configuration, at least one of said rollers being driven by a first shaft journalled in said housing and operatively connected to a drive motor;

a substantially circular alignment means adapted for rotation with and about the common axis of said rollers for positioning the workpiece edge relative to said securing means and over which the open end of said tubular workpiece is positioned during sewing, said alignment means comprising an assemblage of annularly arranged wheels a portion of whose periphery projects beyond the periphery of said rollers and which are capable of rotation in a direction transverse to the rotational direction of said rollers, a second shaft telescopically arranged with respect to the first shaft, a second drive motor operatively connected to said second shaft and a coupling means operatively connecting the second shaft with said wheels and capable of imparting motion to said wheels when the rotational speeds of said first and second shafts vary; and means for regulating the relative speeds of said first and second shafts as a function of the lateral placement of the workpiece edge.

16. The invention according to claim 15 wherein the rotational speed of said rollers is synchronous with the workpiece advancement rate.

17. The invention according to claim 15 wherein said coupling means is ineffective to impart motion to said wheels when said rollers and said alignment means synchronously rotate.

18. The invention according to claim 15 wherein said coupling means comprises a worm gear fixedly mounted on said second shaft and said wheels are gears that are operatively associated with said worm gear.

19. The invention according to claim 15 wherein said means for mounting are adapted to allow for positioning of said rollers at varying distances away from said means for securing.

20. Apparatus for tensioning at least part of a tubular workpiece and guiding its open ended edge relative to the stitch forming location of a sewing machine, said apparatus comprising:

rotatable tensioning parts adapted to receive at least part of the tubular workpiece and to enable the open ended workpiece edge that is to be sewn to be fed to the sewing machine stitch forming location;

means for monitoring the position of the edge to be sewn relative to the sewing machine stitch forming location; and workpiece alignment means operatively associated and rotatable with at least one of said rotatable tensioning parts and capable of displacing the workpiece edge to be sewn in a direction transverse to the direction of feed upon lateral deviation of the workpiece edge from its monitored position whereby the workpiece edge is automatically aligned relative to the sewing machine stitch forming location.

21. Apparatus according to claim 20 wherein said workpiece alignment means includes a series of wheels arranged in an annular manner about the axis of rotation of its associated rotatable tensioning part and are adapted for rotation in planes lying radially of the axis of rotation of said tensioning part.

22. Apparatus according to claim 20 wherein upon lateral deviation of the workpiece edge relative to its monitored position, the monitoring means feeds corrective data to an adjusting member which controls the relative rotational speeds of the tensioning parts and alignment means whereby correcting for such deviation.

23. The invention according to claim 20 further including means for mounting said apparatus relative to said sewing machine.

24. The invention according to claim 23 wherein said rotatable tensioning part and said workpiece alignment means each has an independent drive associated therewith.

25. The invention according to claim 24 wherein the output of the drive associated with said workpiece alignment means is operatively coupled thereto and the output of the drive associated with said rotatable tensioning part is nonrotatably connected to the mounting means for said apparatus.

26. The invention according to claim 24 further including slip-ring assembly means for transmitting energy to both motors.

27. The apparatus according to claim 25 wherein said rotatable tensioning parts and said workpiece alignment means are both driven by a tubular power shaft within which said independent drives are arranged.

28. The invention according to claim 27 wherein both of said drives are fixedly secured to said power shaft.

29. A tensioning apparatus adapted for use in combination with a sewing machine, said tensioning apparatus comprising:

rotatable tensioning parts for receiving and aligning a tubular workpiece edge, said tensioning parts include annularly arranged alignment elements;

motor means for driving said alignment elements, said motor means being disposed in the tensioning part; and sensing means for controlling the operation of said alignment elements.

* * * * *